US008095042B2

(12) United States Patent
Tamura

(10) Patent No.: US 8,095,042 B2
(45) Date of Patent: Jan. 10, 2012

(54) IMAGE FORMING APPARATUS AND METHOD OF CONTROLLING SAME

(75) Inventor: Hirohmi Tamura, Ebina (JP)

(73) Assignee: Ricoh Company, Ltd., Tokyo (JP)

( * ) Notice: Subject to any disclaimer, the term of this patent is extended or adjusted under 35 U.S.C. 154(b) by 887 days.

(21) Appl. No.: 12/155,646

(22) Filed: Jun. 6, 2008

(65) Prior Publication Data

US 2008/0304879 A1 Dec. 11, 2008

(30) Foreign Application Priority Data

Jun. 11, 2007 (JP) ..... 2007-154067

(51) Int. Cl.
*G03G 15/22* (2006.01)
*G03G 15/16* (2006.01)

(52) U.S. Cl. ..... 399/148; 399/307

(58) Field of Classification Search ..... 399/148, 399/299, 307
See application file for complete search history.

(56) References Cited

U.S. PATENT DOCUMENTS

| | | | | |
|---|---|---|---|---|
| 7,228,088 | B2 * | 6/2007 | Shimmura | 399/101 |
| 7,613,419 | B2 * | 11/2009 | Suzuki et al. | 399/307 |
| 2003/0129006 | A1 * | 7/2003 | Hoshi et al. | 399/298 |
| 2006/0008302 | A1 | 1/2006 | Someya et al. | |
| 2007/0065188 | A1 | 3/2007 | Takagaki et al. | |
| 2007/0212126 | A1 | 9/2007 | Seto et al. | |
| 2007/0212129 | A1 | 9/2007 | Takemoto et al. | |
| 2007/0218386 | A1 | 9/2007 | Suzuki et al. | |
| 2008/0008505 | A1 | 1/2008 | Seto et al. | |
| 2008/0069610 | A1 | 3/2008 | Nakafuji et al. | |

FOREIGN PATENT DOCUMENTS

| | | |
|---|---|---|
| JP | 3042414 | 3/2000 |
| JP | 2003-154828 | 5/2003 |
| JP | 2004-145260 | 5/2004 |
| JP | 2005-258043 | 9/2005 |

OTHER PUBLICATIONS

Abstract of JP 10-063121 published Mar. 6, 1998.

* cited by examiner

*Primary Examiner* — David Gray
*Assistant Examiner* — Erika J Villaluna
(74) *Attorney, Agent, or Firm* — Harness, Dickey & Pierce, P.L.C.

(57) ABSTRACT

An image forming apparatus includes a plurality of first image carriers on which different color toner images C are respectively formed, a transfer fixing member onto which a multicolor toner image A consisting of the toner images C is transferred, a heater located configured to fuse the toner image A on the transfer fixing member, a pressurizer pressing against the transfer fixing member, an image carrier located upstream of the transfer fixing member in a direction in which the recording medium is transported, on which a toner image B is formed, and a transferer facing the image carrier. The toner image A is transferred from the transfer fixing member and fixed on a recording medium in a nip formed between the transfer fixing member and the pressurizer. The toner image B is transferred from image carrier onto the recording medium before the toner image A is transferred thereonto and fixed thereon.

17 Claims, 6 Drawing Sheets

IMAGE FORMING APPARATUS AND METHOD OF CONTROLLING SAME

CROSS-REFERENCE TO RELATED APPLICATIONS

This patent specification claims priority from Japanese Patent Application No. 2007-154067, filed on Jun. 11, 2007, in the Japan Patent Office, the entire contents of which are hereby incorporated by reference herein.

BACKGROUND OF THE INVENTION

1. Field of the Invention

The present invention generally relates to an electronographic image forming apparatus such as a copier, a printer, a facsimile machine, and a multifunction machine including at least two of these functions, and a controlling method thereof.

2. Discussion of the Background Art

Electrophotographic image forming apparatuses typically form an electrostatic latent image on a photoreceptor and develop the electrostatic latent image with a dry toner into a toner image. The toner image is then electrostatically transferred from the photoreceptor onto a recording medium such as a sheet, and fixed thereon.

However, a surface of the recording medium has a certain degree of roughness and consequently the recording medium does not completely and evenly contact the photoreceptor but forms uneven gaps therebetween. Such gaps distort a transfer electrical field and cause a repulsive Coulomb force among toner particles. Further, because electrical resistivity of the recording medium is related to a moisture content therein and depends on environmental conditions around the image forming apparatus, such as temperature and humidity, the toner image might be distorted as the environmental conditions change.

Still further, such surface roughness of the recording medium makes gloss of the fixed image uneven. In particular, uniform gloss is preferred in color images having a relatively high ratio of solid areas to clear areas (hereinafter referred to as solid portion ratio).

To solve the problems described above, one known image forming apparatus includes an intermediate transfer member facing a photoreceptor, a heating member, and a transfer fixing unit.

In such an image forming apparatus, multicolor toner images are primarily transferred from the photoreceptor, superimposed one on another on the intermediate transfer member, and fused by the heating member. Then, the transfer fixing unit secondarily transfers the fused toner image from the intermediate transfer member onto the recording medium and fixes the toner image thereon.

The method described above, in which transferring the toner image onto the recording medium and fixing the toner image thereon are simultaneously performed, is hereinafter referred to as a transfer fixing method. By contrast, a method in which fixing the toner image on the recording medium is performed separately from transferring the toner image thereonto is hereinafter referred to as simply a fixing method.

The transfer fixing method can achieve a relatively high level of gloss that is uniform and reduce image failure due to the surface roughness of the recording medium and change in the resistivity thereof.

However, in the image forming apparatus described above, the intermediate transfer member is heated for a time period during which the toner image is heated, and the photoreceptor is heated when the heated portion of the intermediate transfer member contacts the photoreceptor. In such a case, a subsequent toner image formed on the photoreceptor is likely to adhere to the photoreceptor, as a result of which physical characteristics of the photoreceptor might change.

Although cooling the intermediate transfer member with a cooler and preventing temperature rising thereof with a heat sink have been proposed so as to prevent such adhesion of the toner image to the photoreceptor, cooling the intermediate transfer member adequately is difficult. Further, such a cooler increases both the cost of the image forming apparatus as well as electrical consumption.

Another known image forming apparatus applying the transfer fixing method in which the intermediate transfer member is not heated directly is described below.

In such an image forming apparatus, four photoreceptors on which yellow, cyan, magenta, and black toner images are respectively formed are provided along a horizontally-extending transfer surface of the intermediate transfer belt, and the transfer fixing unit is located downstream of the photoreceptors in a direction in which the intermediate transfer belt moves. The transfer fixing unit includes a transfer fixing roller facing the intermediate transfer belt, a pressure roller pressing against the transfer fixing roller, and a heater to heat the transfer fixing roller.

The toner images formed on the photoreceptors are transferred and superimposed one on another on the intermediate transfer belt. This superimposed toner image is then transferred from the intermediate transfer belt onto the transfer fixing roller and fused thereon. Then, in a nip formed between the transfer fixing roller and the pressure roller, the toner image is transferred from the transfer fixing roller onto a recording medium and fixed thereon simultaneously.

In the image forming apparatus described above, because the intermediate transfer belt is not directly heated and accordingly receives a relatively small amount of heat, change in the physical characteristics of the photoreceptor and the adhesion of the toner thereto can be prevented or reduced. Further, because the toner image is fused into a film on the transfer fixing roller and then transferred therefrom onto the recording medium, a higher gloss level can be achieved.

In a color mode, images having a relatively high solid portion ratio, such as pictures and illustrations, are output and a relatively high level of uniform gloss is preferred. By contrast, in a monochrome mode, images having a relatively low solid portion ratio, such as business documents in which a ratio of lines and characters to pictures and illustrations is higher, are output.

Further, in business documents, a high level of gloss is not always preferred because relatively high gloss documents tend to reflect light, which decreases viewability. Generally, utilization of a monochrome mode and a color mode in color electronographic image forming apparatus is about 50%, respectively.

SUMMARY OF THE INVENTION

In view of the foregoing, in one illustrative embodiment of the present invention, an image forming apparatus includes a plurality of first image carriers on which different color toner images C are respectively formed, a transfer fixing member onto which a multicolor toner image A consisting of the toner images C is transferred, a heater configured to fuse the toner image on the transfer fixing member, a pressurizer pressing against the transfer fixing member, an image carrier located upstream of the transfer fixing member in a direction in which a recording medium is transported, on which a toner image B whose color is different from the color of the toner image A is formed, and a transferer facing the image carrier. The toner image A is transferred from the transfer fixing member and fixed on a recording medium in a nip formed between the transfer fixing member and the pressurizer. The toner image B is transferred from image carrier onto the recording medium before the toner image A is transferred thereonto and fixed thereon.

In another illustrative embodiment of the present invention, an image forming apparatus include a single first image carrier on which different color toner images C are formed and superimposed one on another to form a multicolor toner image A, a transfer fixing member onto which the toner image A is transferred, a heater configured to fuse the toner image A on the transfer fixing member, a pressurizer pressing against the transfer fixing member, an image carrier located upstream of the transfer fixing member in a direction in which the recording medium is transported, on which a toner image B whose color is different from a color of the toner image A is formed, and a transferer facing the image carrier. The pressurizer and the transfer fixing member form a nip in which the fused toner image A is transferred from the transfer fixing member and fixed on a recording medium. The toner image B is transferred onto the recording medium before the toner image A is transferred thereonto and fixed by the transfer fixing member and the pressurizer on the recording medium.

Yet in another illustrative embodiment of the present invention, a method of controlling an image forming apparatus including at least one first image carrier on which a toner image C is formed, a second image carrier, a transfer fixing member onto which a multicolor toner image A including the toner image C is transferred from the second image carrier, and a third image is disclosed. The control method includes forming a toner image B on the third image carrier, transferring the toner image B onto a recording medium at a position upstream of the transfer fixing member in a direction in which the recording medium is transported, fixing the toner image B on the recording medium in a nip formed between the transfer fixing member and a pressurizer pressing against the transfer fixing member, and disengaging the second image carrier from the transfer fixing member during single color toner formation. A color of the toner image B is different from a color of the multicolor toner image A.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
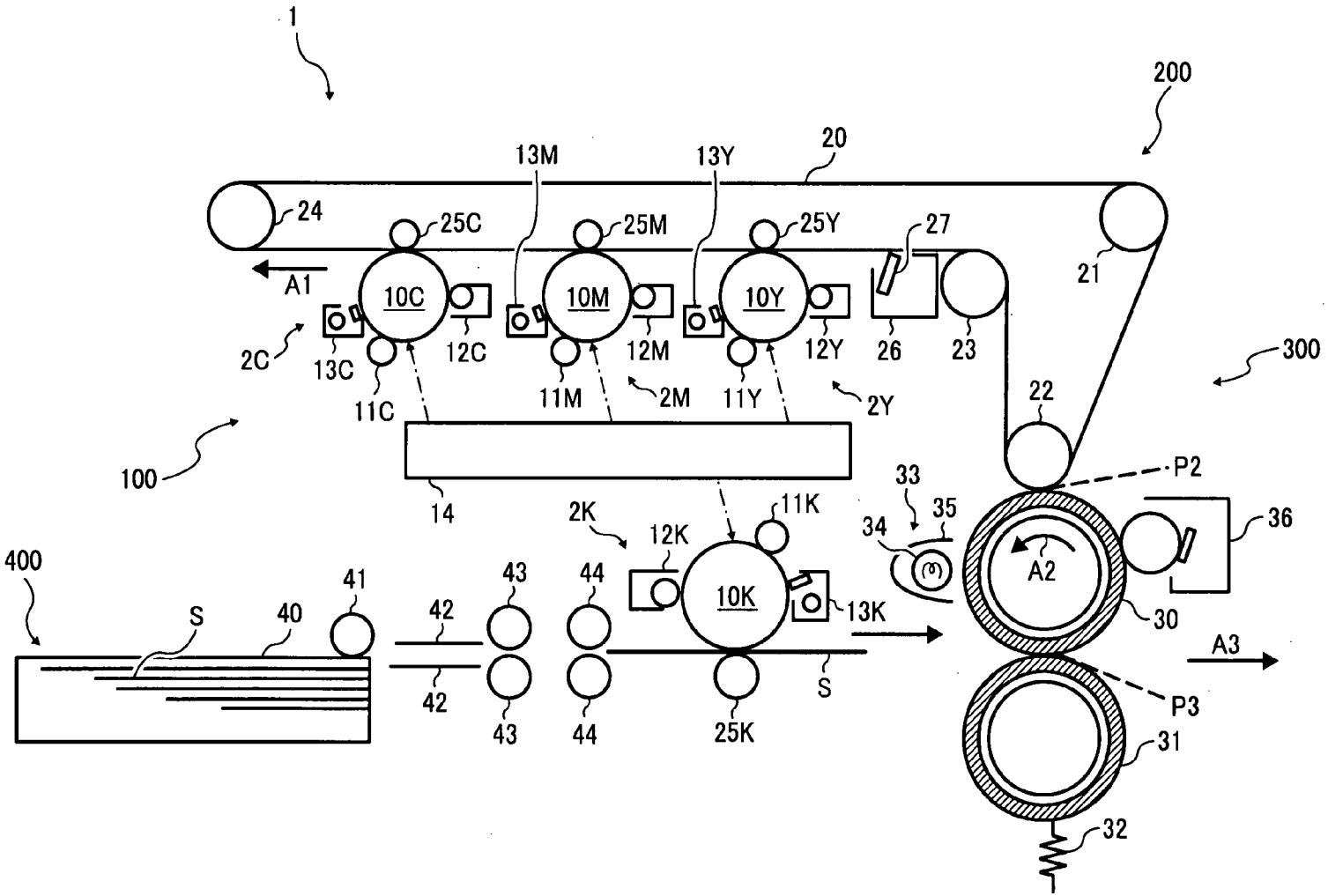
FIG. 1 illustrates a schematic configuration of an image forming apparatus according to an illustrative embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, a tandem color image forming apparatus 1 according to an illustrative embodiment of the present invention is described.

The image forming apparatus 1 shown in FIG. 1 includes multiple first image carriers arranged in tandem and a transfer fixing member to perform a tertiary transfer process. As shown in FIG. 1, the image forming apparatus 1 that in the present embodiment is a copier includes an image forming unit 100, an intermediate transfer unit 200, a transfer fixing unit 300, a sheet transport unit 400, and an image reading unit, not shown, provided over the image forming unit 100. The image forming apparatus 1 further includes a controller, not shown, to control respective portions thereof.

The image forming unit 100 includes color image forming stations 2Y, 2M, and 2C that form yellow, magenta, and cyan images (toner images C or different color toner images), respectively, and have an identical or similar configuration. These color image forming stations 2Y, 2M, and 2C include drum-shaped photoreceptors 10Y, 10M, and 10C, respectively, that serve as first image carriers, rotate counterclockwise in FIG. 1., and are arranged parallel to each other. A black image forming station 2K for forming a black image (toner image B or single color toner image) is provided below these image forming stations 2Y, 2M, and 2C in FIG. 1, and includes a photoreceptor 10K serving as a third image carrier on which a toner image B is formed.

In FIG. 1, reference characters Y, C, M, and K indicate yellow, cyan, magenta, and black, respectively, and these reference characters are omitted when color identification is not required.

Around each photoreceptor 10, a charger 11, a developing unit 12, and a primary cleaner 13 are provided. The developing units 12Y, 12C, 12M, and 12K include a different color toner. The image forming stations 2Y, 2M, 2C, and 2K are provided with a common writing unit 14.

In the example illustrated in FIG. 1, the yellow, magenta, and cyan toners are used in a transfer fixing method, and the black toner is used in a fixing method. It is to be noted that, in the present embodiment, at least one colored toner is used in both the transfer fixing method and the fixing method, and a transparent toner is not used. Further, it is to be noted that the toners are negatively charged in the present embodiment.

The intermediate transfer unit 200 includes a belt-shaped intermediate transfer member 20 that serves as a second image carrier and is movable clockwise as indicated by arrow A1 in FIG. 1, looped around a driving roller 21, a secondary transfer roller 22, a cooling roller 23, and a driven roller 20. The intermediate transfer member 20 includes a release layer including a fluorine resin, such as PFA (perfluoro alkoxy) and PTFE (polytetrafluoroethylene), on its surface to facilitate toner image transfer.

The image forming stations 2Y, 2M, and 2C include primary transfer rollers 25Y, 25M, and 25C that are transferers and press against the photoreceptors 10Y, 10M, and 10C via the intermediate transfer member 20 at respective primary transfer positions (primary transfer nips). The primary transfer rollers 25Y, 25M, and 25C transfer the yellow, magenta, and cyan toner images formed on the photoreceptors 10Y, 10M, and 10C onto the intermediate transfer member 20, respectively.

The image forming station 2K includes a primary transfer roller 25K that presses against the photoreceptor 10K and transfers a black toner image from the photoreceptor 10K onto a sheet S of a recording medium at a black transfer nip formed between the transfer roller 25K and the photoreceptor 10K.

A secondary cleaner 26 is provided downstream of the secondary transfer roller 22 in the direction of movement indicated by arrow A1 so as to clean the surface of the intermediate transfer member 20. The secondary cleaner 26 uses a cleaning blade 27 as a cleaning member, and an edge portion of the cleaning blade 27 presses against the surface of the intermediate transfer member 20 in a direction opposite the direction of movement indicated by arrow A1. It is to be noted that the cleaning member is not limited to the cleaning blade and may be a cleaning brush or cleaning roller.

The transfer fixing unit 300 includes a transfer fixing roller 30 that is a transfer fixing member and rotatable counterclockwise in FIG. 1 as indicated by arrow A2, a pressure roller 31 that is a pressurizer and presses against the transfer fixing roller 30, and a biasing member 32 that pushes the pressure roller 31 toward the transfer fixing roller 30.

The secondary transfer roller 22 is pushed by a biasing member, not shown, and presses against the transfer fixing roller 30 via the intermediate transfer member 20, forming a secondary transfer nip at a secondary transfer position P2. Further, by pressing the pressure roller 31 against the transfer fixing roller 30 with the biasing member 32, a tertiary transfer nip is formed therebetween at a tertiary transfer position P3.

The transfer fixing roller 30 includes a metal core that is a metal pipe including aluminum, etc., and an elastic layer formed on the metal core, coated with a release layer. Examples of a material of the elastic layer include silicone rubber, and examples of a material of the release layer include fluorine resin, such as PFA and PTFE. In the elastic layer and/or the release layer of the transfer fixing roller 30, an ionic conductive material and/or an electrically conductive material, such as carbon, is dispersed as an electrical resistivity regulator.

The transfer fixing unit 300 further includes a heating unit 33 and a tertiary cleaner 36 both located around the transfer fixing roller 30. The heating unit 33 is located downstream of the secondary transfer position P2 in the direction of movement indicated by arrow A2 in the example shown in FIG. 1. The heating unit 33 includes a halogen heater 34 and a reflection plate 35 that reflects a radiation heat of the halogen heater 34 so as to effectively heat the toner image on the transfer fixing roller 30. The tertiary cleaner 36 is provided downstream of the tertiary transfer position P3 an d upstream of the secondary transfer position P2 in the direction of movement indicated by arrow A2.

It is to be noted that, although FIG. 1 illustrates an example in which the heating unit 33 is located around the transfer fixing roller 30, alternatively, the cylindrical transfer fixing roller 30 may be heated from inside by the heating unit 33 located therein. Further, alternatively, the transfer fixing roller 30 may include a metal heating layer and be heated through induction heating using an exciting coil provided upstream of the tertiary transfer position P3, close to the transfer fixing roller 30.

The sheet transport unit 400 includes a sheet cassette 40 containing multiple sheets S (recording medium), a feed roller 41 to feed the sheets S from the sheet cassette 40 one by one from the top, a pair of guide plates 42 to guide the sheet S, a pair of transport rollers 43 to transport the sheet S, and a pair of registration rollers 44. The registration rollers 44 stops the sheet S transported by the transport rollers 43, guided by the guide plates 42, and then forwards the sheet S to a nip (black transfer nip) formed between the photoreceptor 10K and the transfer roller 25K.

A copying process using the image forming apparatus 1 shown in FIG. 1 is described below. It is to be noted that a monochrome mode and a color mode are selectable in the image forming apparatus 1, and the controller, not shown, controls the respective portions of the image forming apparatus 1 to form images in the monochrome mode and the color mode, respectively.

Firstly, a user sets an original document on a document table of an automatic document feeder (ADF), not shown, or lifts the ADF, sets the original document on a contact glass of the image reading unit, not shown, and then lowers the ADF to hold the original document with the ADF.

When the user pushes a start button, not shown, the original document set in the ADF is automatically moved onto the contact glass, not shown, and the image reading unit, not shown, reads image information thereof. By contrast, when the original document is set on the contact glass, the image reading unit immediately reads the image information thereof.

Further, when the user pushes the start button, not shown, in a color mode, the photoreceptors 10Y, 10M, 10C, and 10K start rotating at a proper timing, and surfaces thereof are negatively charged uniformly by the chargers 11Y, 11M, 11C, and 11K, respectively. Then, the writing unit 14 directs a laser light onto the surface of each of the photoreceptors 10Y, 10M, 10C, and 10K according to the image information read by the image reading unit so as to form an electrostatic latent image thereon. The developing units 12Y, 12M, 12C, and 12K develop the electrostatic latent images, forming the yellow, magenta, cyan, and black toner images on the photoreceptors 10Y, 10M, 10C, and 10K, respectively.

Further, the driving roller 21 of the intermediate transfer unit 200 is rotated by a driving motor, not shown, at a proper timing, and accordingly the secondary transfer roller 22, the cooling roller 23, and the driven roller 24 are rotated, which moves the intermediate transfer member 20.

As the intermediate transfer member 20 moves, the primary transfer rollers 25Y, 25M, and 25C transfer the yellow, magenta, and cyan toner images (toner images C) from the photoreceptors 10Y, 10M, and 10C sequentially at the primary transfer positions, and superimpose these images one on another to form a multicolor color toner image (toner image A) on the intermediate transfer belt 20 in a primary transfer process.

After the toner images are transferred from the photoreceptors 10Y, 10M, and 10C, the primary cleaners 13Y, 13M, and 13C remove any toner remaining thereon. Then, a discharge lamp, not shown, initializes the surface of each of the photoreceptors 10Y, 10M, and 10C by removing electrical charges therefrom as preparation for subsequent image formation.

Further, the transfer fixing roller 30 of the transfer fixing unit 300 is rotated by a driving motor, not shown, at a proper timing, which rotates the pressure roller 31. The color toner image formed on the intermediate transfer member 20 is transferred onto the transfer fixing roller 30 in a secondary transfer process by the secondary transfer roller 22 at the secondary transfer position P2. The toner image is then heated to a predetermined or given temperature and fused on the transfer fixing roller 30 by the heating unit 33.

After passing through the secondary transfer position P2, the intermediate transfer member 20 is cooled by the cooling roller 23, and then the secondary cleaner 26 removes any toner remaining thereon.

Along with the operations described above, in the sheet transport unit 400, a driving motor, not shown, rotates the feed roller 41 so as to transport the sheet S from the sheet cassette 40. The sheet S is transported by the transport rollers 44, and then the registration rollers 44 stop the sheet S by sandwiching a leading edge thereof. Then, the registration rollers 44 rotate in synchronization with the black toner image formed on the photoreceptor 10K and the color toner image on the transfer fixing roller 30 and transport the sheet S toward the black transfer nip. At the black transfer nip, the black toner (toner image B) formed on the photoreceptor 10K is electrostatically transferred onto the sheet S.

The sheet S is further forwarded to the tertiary transfer position P3, where the multicolor color toner image (toner image A) on the transfer fixing roller 30 is transferred and fixed with pressure on the sheet S simultaneously at the tertiary transfer position P3 in a tertiary transfer process. The sheet S on which the image is thus recorded is discharged in a direction indicated by arrow A3. The primary cleaner 13K removes any toner remaining on the photoreceptor 10K after the black toner images is transferred therefrom, and the black toner thus removed is supplied again to the developing unit 12K and reused. Further, the surface of the photoredeptor 10K is discharged.

By contrast, in a monochrome mode or single color image formation, the controller, not shown, controls a disengaging member, not shown, to disengage the transfer fixing roller 30 from the intermediate transfer member 20. After the black toner image formed on the photoreceptor 10K is electrostatically transferred onto the sheet S forwarded by the registration rollers 44, the toner image is fixed with the transfer fixing roller 30 and the pressure roller 31, and then the sheet S is discharged in the direction indicated by arrow A3.

It is to be noted that the controller, not shown, may deactivate the photoreceptors 10Y, 10M, and 10C and the driving roller 21 during the monochrome mode.

Alternatively, during the monochrome mode, the controller, not shown, may perform a process control process including at least one of adjustment of image density and/or color deviation of the multicolor image (toner image A), cooling of the intermediate transfer member 20, and cleaning of the intermediate transfer member 20.

Color deviation means that the yellow, magenta, and cyan toner images are not aligned properly in the multicolor image. Such adjustment includes forming a toner pattern to detect image density and/or color deviation on the intermediate transfer member 20.

It is to be noted that when the intermediate transfer member 20 is cooled and/or cleaned, it is being rotated by the driving roller 21 and a disengaging member, not shown, disengages the photoreceptors 10Y, 10M, and 10C from the intermediate transfer member 20.

After the tertiary transfer process, the tertiary cleaner 36 removes any toner remaining on the transfer fixing roller 30.

To describe advantages of the image forming apparatus 1, shown in FIG. 1, according to the illustrative embodiment of the present embodiment that combines the fixing method and the transfer fixing method together, a typical image forming apparatus employing only the transfer fixing method is described below with reference to FIG. 2.

It is to be noted that descriptions regarding portions identical or similar to those of the image forming apparatus 1 shown in FIG. 1 are omitted.

Figure 2:
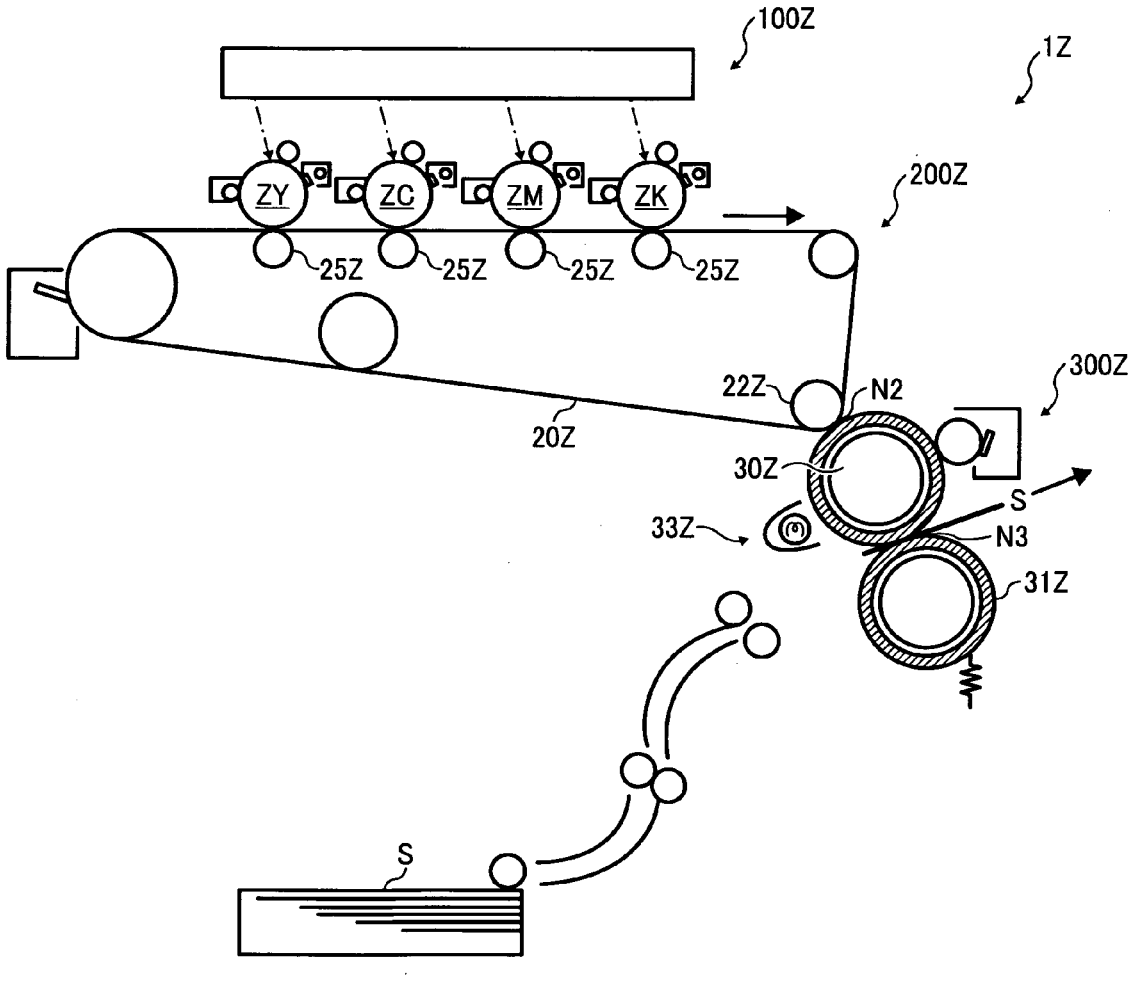
FIG. 2 is illustrates a schematic configuration of a comparative image forming apparatus employing a transfer fixing method.

FIG. 2 illustrates a comparative image forming apparatus 12 employing the transfer fixing method.

As shown in FIG. 2, the image forming apparatus 12 includes an image forming unit 100Z including four photoreceptor drums ZY, ZC, ZM, and ZK on which yellow, cyan, magenta, and black toner images are respectively formed, an intermediate transfer unit 200Z including an intermediate transfer belt 20Z, and a transfer fixing unit 300Z.

The intermediate transfer belt 20Z has a horizontally-extending transfer surface along which the photoreceptor drums ZY, ZC, ZM, and ZK are arranged in tandem. The toner images formed on the photoreceptor drums ZY, ZC, ZM, and ZK are transferred by primary transfer rollers 25Z at primary transfer nips, respectively, and superimposed one on another to form a multicolor image on the intermediate transfer belt 20Z.

The transfer fixing unit 300Z includes a transfer fixing roller 30Z located to face the intermediate transfer belt 20Z, a pressure roller 31Z pressing against the transfer fixing roller 30Z to form a tertiary transfer nip N3, and a heater 33Z to heat the transfer fixing roller 30Z. A secondary transfer roller 22Z presses against the transfer fixing roller 30Z via the intermediate transfer belt 20Z, forming a secondary transfer nip N2 therebetween.

The multicolor image is transferred from the intermediate transfer belt 20Z onto the transfer fixing roller 30Z at the secondary transfer nip N2 and then fused on the transfer fixing roller 30Z. At the tertiary transfer nip N3, the fused toner image is further transferred from the transfer fixing roller 30Z onto a recording medium S, and fixed thereon.

Now, the advantages of the image forming apparatus 1 shown in FIG. 1 are described below, compared with the comparative image forming apparatus 12 described above. The color mode using typical black, magenta, cyan, and yellow toners and the monochrome mode using the typical black toner are described below as examples.

1. Durability

In the comparative image forming apparatus 12 shown in FIG. 2, although not being directly heated, the intermediate transfer member 20Z is damaged to a certain degree by being heated by the transfer fixing unit 300Z even in the monochrome mode, which is frequently used. By contrast, in the image forming apparatus 1 shown in FIG. 1 according to the illustrative embodiment of the present invention, the transfer fixing roller 30 (transfer fixing member) is disengaged from the intermediate transfer member 20 (second image carrier) in the monochrome mode so that the intermediate transfer member 20 and the photoreceptors 10 are not heated by the transfer fixing unit 300, and thus greater durability can be achieved.

2. Selectability of Black Image Quality

In the image forming apparatus 1 shown in FIG. 1, business documents can be output in the monochrome mode using the fixing method serving as a lower quality and lower gloss mode because such documents generally do not require higher levels of image quality and gloss. By contrast, color images with a higher solid portion ratio can be output in a higher quality and uniform gloss mode in which the cyan, magenta, and yellow toner images are fixed on the black toner image in the transfer fixing mode.

3. Maintenance of the Intermediate Transfer Member and the Process Control During the Monochrome Mode In the image forming apparatus 1 shown in FIG. 1, while the black images are formed in the monochrome mode, the intermediate transfer member 20 can be cleaned and/or cooled and the image density and color deviation of the color image (toner image A) can be adjusted because the intermediate transfer member 20 serving as the second image carrier can be disengaged from the transfer fixing roller 30. Similarly, while the color images are formed, the photoreceptor 10K can be cleaned and/or black image density can be adjusted. Thus, time efficiency of an image formation sequence is higher in the image forming apparatus 1 shown in FIG. 1.

4. Cleaning in the Cases of Jam and/or Forcible Power-Off

In the comparative image forming apparatus 12, shown in FIG. 2, employing the transfer fixing method, an amount of toner fused and adheres to the transfer fixing member is greater and removal of such toner is more difficult when the power is forcibly turned off due to jam, power failure, etc., compared to an image forming apparatuses employing the fixing method. By contrast, because the image forming apparatus 1 shown in FIG. 1 does not employ the transfer fixing method at least during the monochrome mode, cleaning of the transfer fixing member in such cases is relatively easy.

5. A Monochrome Image First Print Time

In the image forming apparatus 1Z, shown in FIG. 2, employing only the transfer fixing method, the black image forming station of the four image forming stations is typically located at an extreme downstream position, that is, closest to the transfer fixing roller 30Z, in a direction in which the intermediate transfer member moves so as to reduce a first print time in the frequently used monochrome mode. However, as in the image forming apparatus 1Z shown in FIG. 2, when the intermediate transfer member is not directly heated, the black toner image travels for a longer distance, which increases the first print time.

By contrast, when the black image forming station 2K is provided separately from color image forming stations 2C, 2M, and 2Y as in the image forming apparatuses 1 shown in FIG. 1 so as to perform transferring and fixing of the black image separately in the fixing method, the black toner image travels only for a distance between the black transfer nip and the tertiary transfer position P3. This distance can be shorter than a distance traveled by the black image in the image forming apparatus 12 shown in FIG. 2, which is a distance from the primary transfer nip to the tertiary transfer nip N3 via the secondary transfer nip N2. Thus, the first print time in the monochrome mode can be reduced in the image forming apparatus 1 shown in FIG. 1.

6. Black Toner Reusability

Typically, the toner removed from the photoreceptors is sent to a used-toner container and stored therein together with the toner removed from the intermediate transfer member. Monochrome image forming apparatuses generally reuse the used toner because a certain amount of toner is wasted when these used toners are not reused. In color image forming apparatuses, consumption of the black toner is generally greater than those of the yellow, cyan, and magenta toners, and reusing the black toner is effective to reduce cost as well.

However, in the image forming apparatus 12 shown in FIG. 2, the black toner station is located at the extreme downmost position among the four image forming stations so as to reduce a first print time in the frequently-used monochrome mode as described above. In such a configuration, reusing the black toner is difficult because the yellow, cyan, and magenta toners from the image forming stations located upstream of the black image forming station tend to be transferred onto the black photoreceptor ZK in the color mode. On the other hand, if the black image forming station is located upstream of the color image forming stations to reuse the black toner, reduction of the first print time in the monochrome mode is sacrificed.

By contrast, in the image forming apparatus 1 shown in FIG. 1, the black image forming station 2K is provided separately from color image forming stations 2C, 2M, and 2Y so as to perform transferring and fixing of the black image separately, enabling reuse of the black toner even in the color mode.

Figure 3:
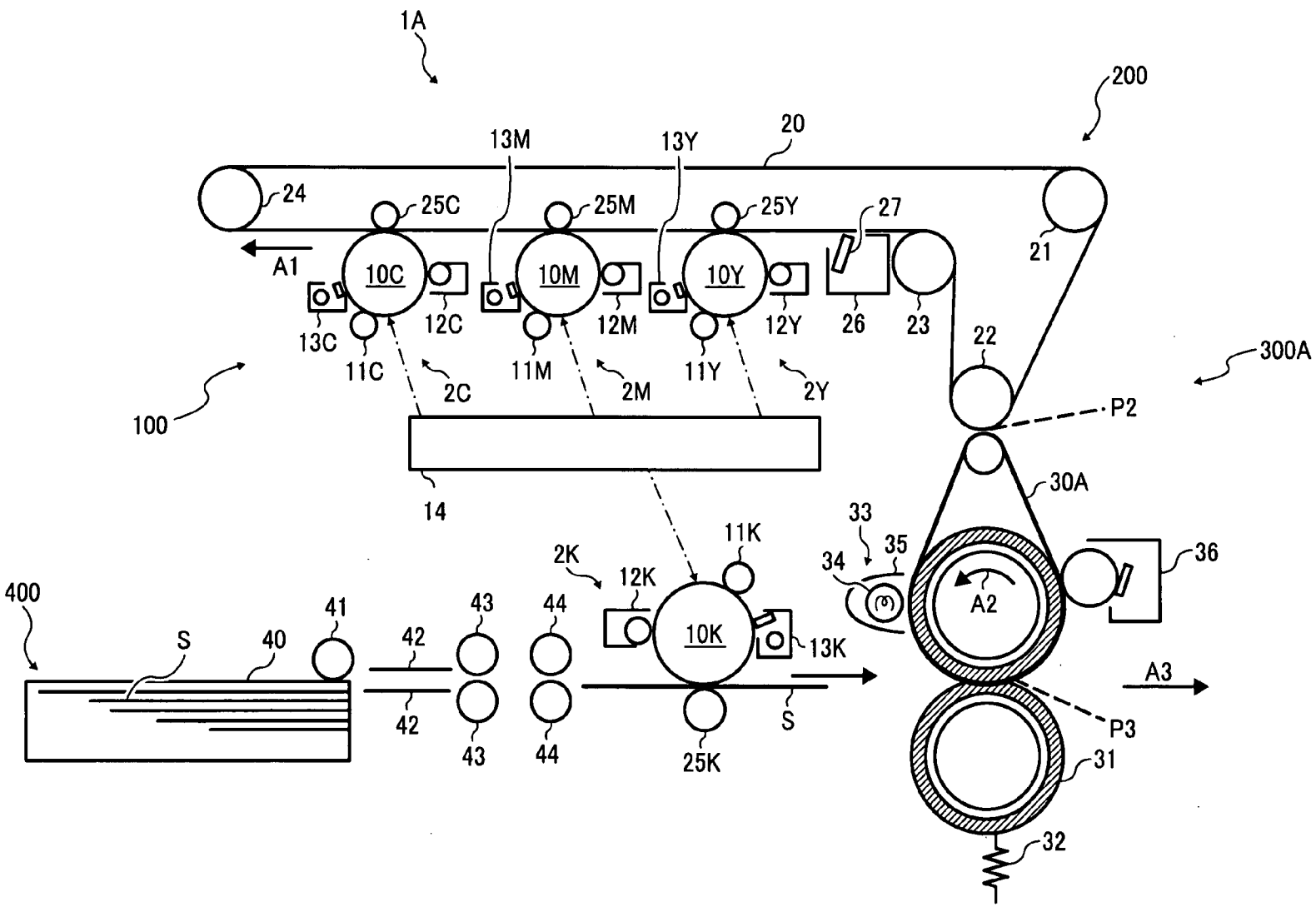
FIG. 3 illustrates a schematic configuration of a variation of the image forming apparatus shown in FIG. 1.

FIG. 3 illustrates an image forming apparatus 1A that includes multiple first image carriers arranged in tandem and performs a tertiary transfer process using a transfer fixing belt as a variation of the present embodiment.

Although the image forming apparatus 1 shown in FIG. 1 uses the cylindrical transfer fixing roller 30 as the transfer fixing member, the image forming apparatus 1A shown in FIG. 3 includes a transfer fixing unit 300A using an endless transfer fixing belt 30A, as a transfer fixing member, that is looped around multiple rollers. The transfer fixing belt 30A preferably includes a base, an elastic layer formed on the base, and a release layer provided over the elastic layer.

It is to be noted that, except for the transfer fixing belt 30A, the image forming apparatus 1A shown in FIG. 3 has a configuration similar to that of the image firming apparatus 1 shown in FIG. 1, and thus descriptions thereof are omitted.

In the image forming apparatus 1A shown in FIG. 3, effects of the present invention can be achieved similarly to the image forming apparatus 1 shown in FIG. 1.

Figure 4:
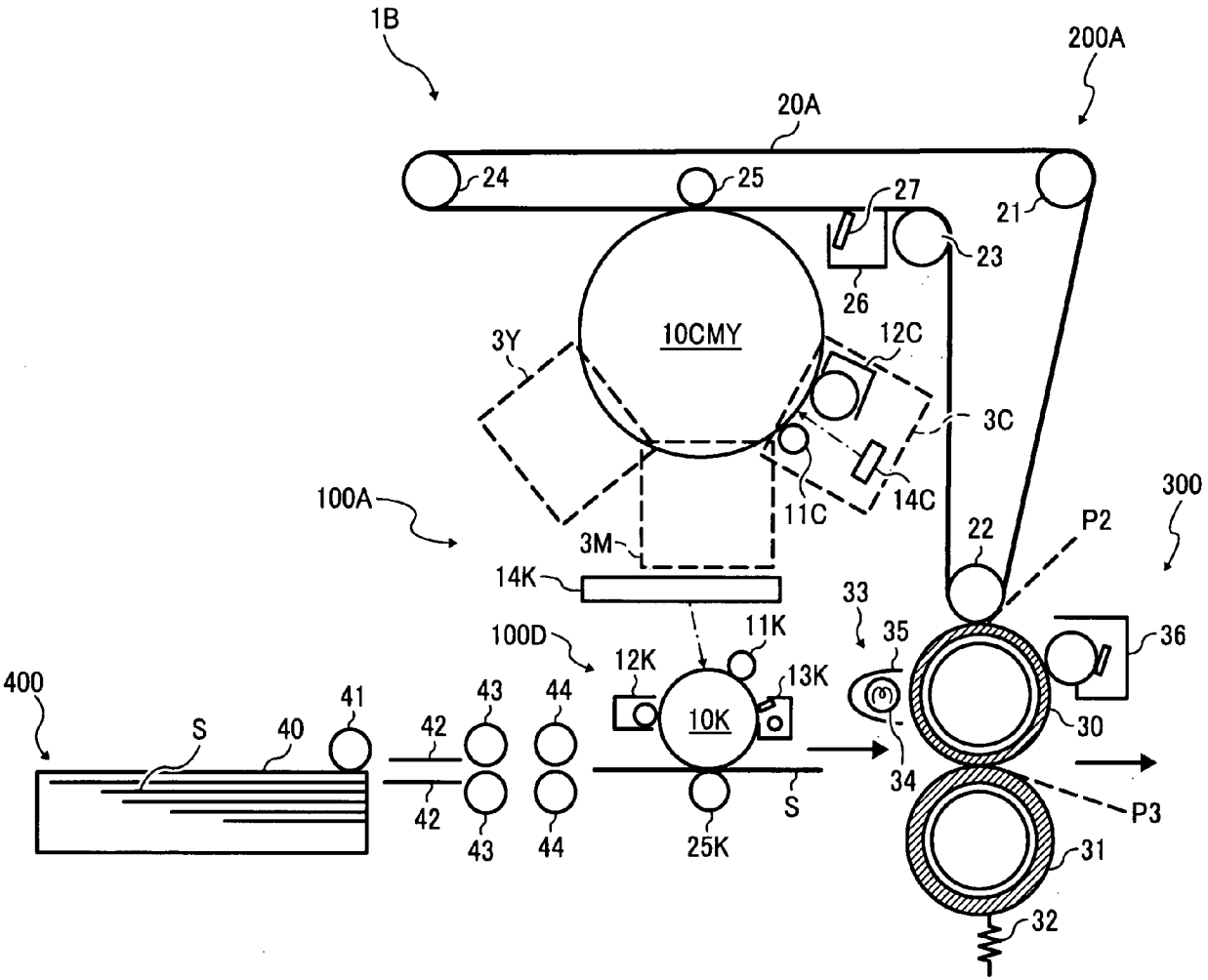
FIG. 4 illustrates a schematic configuration of another variation of the image forming apparatus shown in FIG. 1.

FIG. 4 illustrates an image forming apparatus 1B as another variation of the present embodiment.

The image forming apparatus 1B shown in FIG. 4 includes a single first image carrier employing an image-on-image method, in which a multicolor image is formed on the single image carrier, and performs a tertiary transfer process using a transfer fixing roller.

Although the image forming apparatus 1 shown in FIG. 1 includes the multiple first image carriers (photoreceptors 10Y, 10M, and 10C) arranged in tandem along the intermediate transfer member 20, the image forming apparatus 1B shown in FIG. 4 employs the image-on-image method in which color image forming stations 3C, 3M, and 3Y form a multicolor toner image on a single photoreceptor 10CMY.

More specifically, the image forming apparatus 1B includes image forming units 100A and 100D, an intermediate transfer unit 200A, a transfer fixing unit 300, and a sheet transport unit 400. The image forming unit 100D serves as a black image forming station and is provided separately from the color image forming unit 10A. In the image forming unit 10A, the color image forming stations 3Y, 3M, and 3C for forming yellow, magenta, and cyan images, respectively, are arranged around the photoreceptor 10CMY, and a multicolor image is formed on the photoreceptor 10CMY. The image forming unit 100D includes a charger 11K, a developing unit 12K, a primary cleaner 13K, and a writing unit 14C located around a photoreceptor 10K.

The image forming station 3C includes a charger 11C, a developing unit 12C, and a writing unit 14C. It is to be noted that the image forming stations 3Y and 3M have a configuration similar to that of the image forming station 3C, and descriptions thereof are omitted.

The intermediate transfer unit 200A includes a single primary transfer roller 25 to transfer the multicolor toner image from the photoreceptor 10CMY onto an intermediate transfer member 20A that is differently arranged from that of the image forming apparatus 1 shown in FIG. 1.

Except for portions descriptions above, the image forming apparatus 1B has a configuration similar to that of the image forming apparatus 1 shown in FIG. 1, and thus descriptions thereof are omitted.

In the image forming apparatus 1B shown in FIG. 4, effects of the present invention can be achieved similarly to the image forming apparatus 1 shown in FIG. 1. Further, by employing the image-on-image method, the image forming apparatus can be more compact and a first print time can be reduced.

Another illustrative embodiment of the present invention in which a plurality of first image carriers are arranged in tandem and an intermediate transfer member serves as a transfer fixing member used in the secondary transfer process is described below with reference to FIG. 5.

Figure 5:
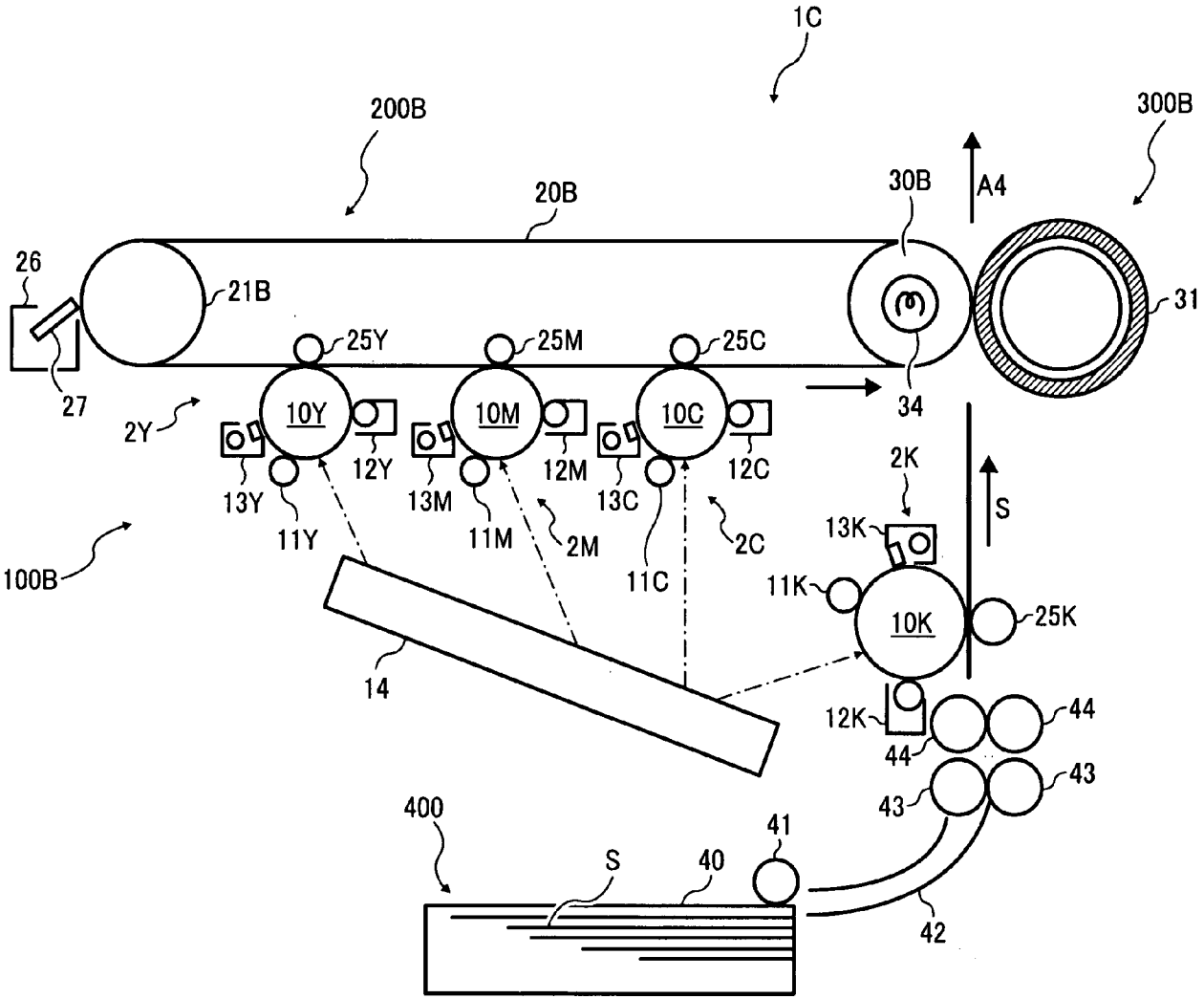
FIG. 5 illustrates a schematic configuration of an image forming apparatus according to another illustrative embodiment of the present invention.

FIG. 5 illustrates a configuration of a main part of a tandem image forming apparatus 1C according to the present embodiment that may be a color copier as an example.

As shown in FIG. 5, the image forming apparatus 1C includes an image forming unit 100B, an intermediate transfer unit 200B provided above the image forming unit 100B in FIG. 5, a transfer fixing unit 300B, a sheet transport unit 400, and an image reading unit, not shown.

Although its arrangement is different from that of the image forming unit 100 shown in FIG. 1 to correspond to the intermediate transfer unit 200B and the transfer fixing unit 300B, the image forming unit 100B has a configuration basically similar to that of the image forming unit 100 shown in FIG. 1.

The intermediate transfer unit 200B includes a belt-shaped intermediate transfer member 20B looped around a driven roller 21B and a transfer fixing roller 30B that rotates the intermediate transfer member 20B counterclockwise in FIG. 5. A halogen heater 34 provided inside the transfer fixing roller 30B heats a toner image on the intermediate transfer member 20B. The intermediate transfer member 20B includes a release layer including PFA, PTFA, etc., on its surface.

The image forming unit 100B includes color image forming stations 2Y, 2M, and 2C for forming yellow, magenta, and cyan toner images, respectively. The color image forming stations 2Y, 2M, and 2C include photoreceptors 10Y, 10M, and 10C against which primary transfer rollers 25Y, 25M, and 25C press via the intermediate transfer member 20B, forming primary transfer nips, respectively.

In the image forming unit 100B, a black image forming station 2K is further provided separately from the image forming stations 2Y, 2M, and 2C, and includes a photoreceptor 10K against which a primary transfer roller 25K presses, forming a black transfer nip where a black image is transferred from the photoreceptor 10K onto a sheet S.

Further, a secondary cleaner 26 including a cleaning blade 27 is provided downstream of the transfer fixing roller 30B in a direction in which the intermediate transfer member 20B moves so as to clean a surface of the intermediate transfer member 20B.

In the image forming unit 100B, a charger 11, a developing unit 12, and a primary cleaner 13 are provided around each photoreceptor 10, and a writing unit 14 is provided to be commonly used by the image forming stations 2Y, 2M, 2C, and 2K, similarly to the image forming unit 100 shown in FIG. 1.

In the transfer fixing unit 300B, the transfer fixing roller 30B and the intermediate transfer member 20B serve as a transfer fixing member. That is, a pressure roller 31 presses against the transfer fixing roller 30B via the intermediate transfer member 20B, and a secondary transfer nip is formed therebetween via the intermediate transfer member 20B.

It is to be noted that the sheet transfer unit 400 is identical to that shown in FIG. 1, and thus descriptions thereof omitted.

Through processes similar to those performed by the image forming apparatus 1 shown in FIG. 1, in a color mode, the yellow, magenta, cyan, and black toner images are formed on the photoreceptors 10Y, 10M, 10C, and 10K, respectively. Then, the yellow, magenta, and cyan toner images (toner images C) are transferred from the photoreceptors 2Y, 2M, and 2C at the primary transfer nips (primary transfer positions), respectively, and superimposed one on another to form a multicolor image (toner image A) on the intermediate transfer member 20B.

As the transfer fixing roller 30B rotates, the pressure roller 31 also rotates and the multicolor image on the intermediate transfer member 20B reaches a position where the transfer fixing roller 30B is located. Because the transfer fixing roller 30B is heated by the halogen heater 34, the multicolor image is fused where the transfer fixing roller 30B is located.

Then, in synchronization with the multicolor image on the intermediate transfer member 20B, a pair of registration rollers 44 forwards a sheet S toward the black transfer nip, where the black toner image is electrostatically transferred from the photoreceptor 10K onto the sheet S.

The sheet S bearing the black image is then forwarded to the secondary transfer nip, where the fused multicolor image is transferred from the intermediate transfer member 20B onto the sheet S and fixed thereon with pressure from the pressure roller 31. The sheet S is discharged in a direction indicated by arrow A4.

As described above, the intermediate transfer member 20B and the pressure roller 31 serve as a fixer to fix the toner image on the sheet S in the present embodiment.

After passing though the secondary transfer nip, the intermediate transfer member 20B is cooled as required, cleaned by the secondary cleaner 26, and then returns to the primary transfer positions.

It is to be noted that, during a monochrome mode or single color image formation, the photoreceptors 10Y, 10M, and 10C may be disengaged from the intermediate transfer member 20B serving as the transfer fixing member by a disengaging member, not shown, and inactivated.

As described above, the image forming apparatus 1C combines together the fixing method and a transfer fixing method in which the intermediate transfer member is directly heated, and the fixer to fix the toner image on the sheet serves as the intermediate transfer member (transfer fixing member) as well. Because the intermediate transfer member serving as the transfer fixing member is heated even in the monochrome mode, the present embodiment has advantages in the first print time in the monochrome mode, cost, and compactness, although durability is not higher, compared to the case in which the intermediate transfer member is not directly heated.

The image forming apparatus 1C has further advantages that the black image quality can be different from the color image quality, cleaning can be easier in the cases of jam and/or forcible power-off, and the black toner is reusable, similarly to the image forming apparatus 1 shown in FIG. 1.

A variation of the present embodiment is described below with reference to FIG. 6. In this variation, a single first image carrier employing the image-on-image method is used and a transfer fixing belt is used in a secondary transfer process.

Figure 6:
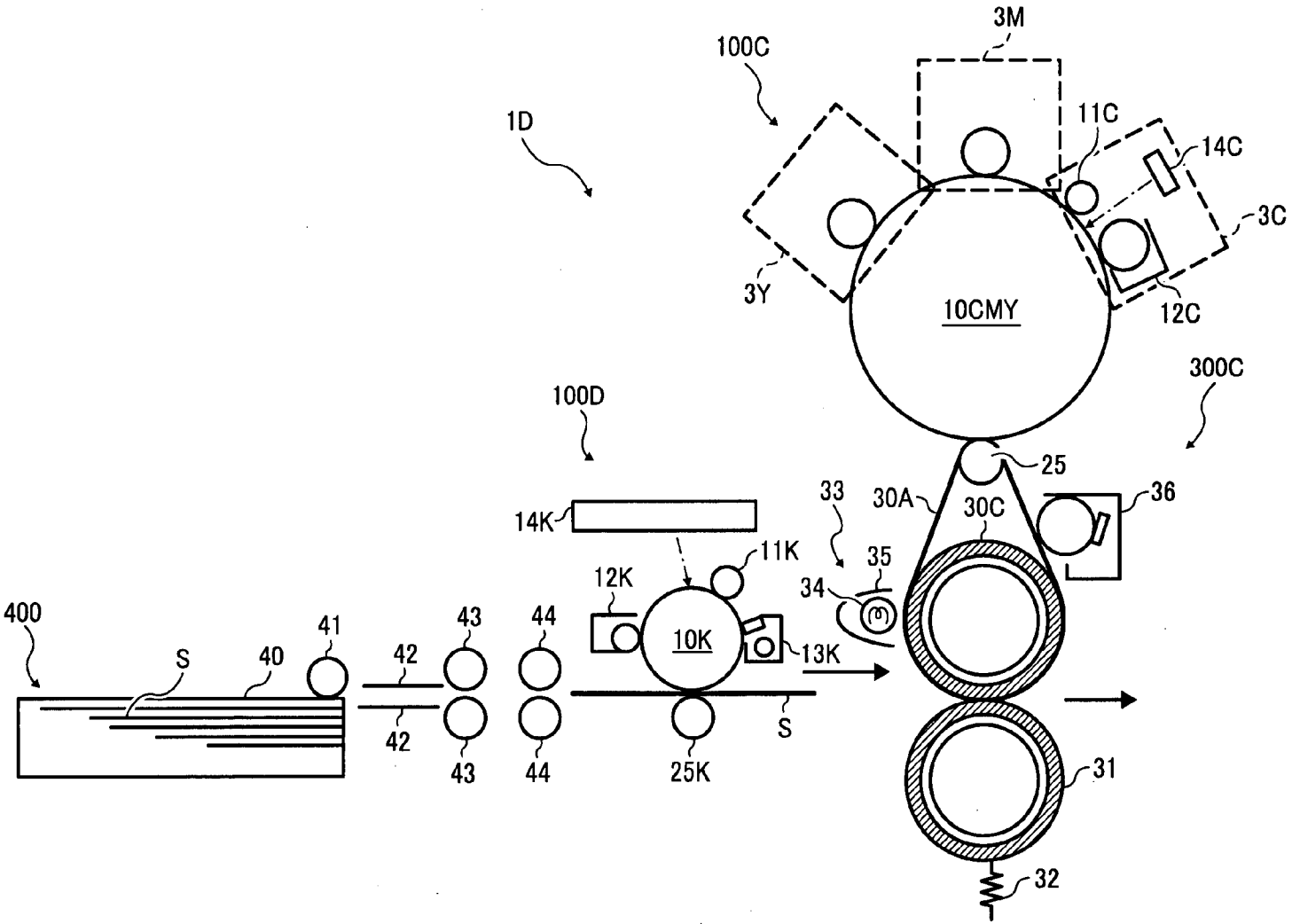
FIG. 6 illustrates a schematic configuration of a variation of the image forming apparatus shown in FIG. 5.

Although the photoreceptors 10Y, 10M, and 10C are arranged in tandem along the intermediate transfer member 20B in the image forming apparatus 1C shown in FIG. 5, FIG. 6 illustrates an image forming apparatus 1D that employs the image-on-image method in which color image forming stations 3C, 3M, and 3Y form a multicolor toner image (toner image A) on a single photoreceptor 10CMY, similarly to the image forming apparatus 1B shown in FIG. 4.

More specifically, the image forming apparatus 1D includes image forming units 100C and 100D, a transfer fixing unit 300C, and a sheet transport unit 400. The image forming unit 100D serves as a black image forming station and is provided separately from the image forming unit 100C.

In the image forming unit 100C, the color image forming stations 3Y, 3M, and 3C are arranged around the photoreceptor 10CMY and form yellow, magenta, and cyan images, respectively, and superimpose one on another to form a multicolor image (toner image C) on the photoreceptor 10CMY.

The image forming unit 100D includes a charger 11K, a developing unit 12K, a primary cleaner 13K, and a writing unit 14K located around a photoreceptor 10K on which a black image is formed. The black image is then transferred from the photoreceptor 10K by the primary transfer roller 25K onto a sheet S fed from the sheet transport unit 400.

Each of the image forming station 3C, 3M, and 3Y includes a charger 11, a developing unit 12, and a writing unit 14.

The transfer fixing unit 300C includes a transfer fixing belt 30A looped around a primary transfer roller 25 and a roller 30C, a pressure roller 31 pressing against the transfer fixing belt 30A, a biasing member 32, a cleaner 36, and a heating unit 33 including a halogen heater 34 and a reflection plate 35. The primary transfer roller 25 presses against the photoreceptor 10CMY via the transfer fixing belt 30A.

The sheet transport unit 400 is identical to that shown in FIG. 1, and thus descriptions thereof omitted.

The multicolor image formed on the photoreceptor 10CMY is transferred in a primary transfer process by the primary transfer roller 25 onto the transfer fixing belt 30A. As the transfer fixing belt 30A moves, rotated by the roller 30C, the multicolor image reaches a nip formed between the roller 30C and the pressure roller 31 via the transfer fixing belt 30A, where the multicolor image is transferred from the transfer fixing belt 30A onto the sheet S bearing the black image. Simultaneously, the black image and the multicolor image are fixed in this nip.

It is to be noted that the photoreceptor 10CMY is disengageable from the transfer fixing belt 30A during the monochrome mode in order to reduce damage caused by heat from the transfer fixing unit 300C.

It is to be noted that the image forming apparatus 1D has a configuration similar to that of the image forming apparatus 1C shown in FIG. 5 except the portions described above, and achieves effects of the present invention similarly to the image forming apparatus 1C shown in FIG. 5.

Further, by employing the image-on-image method, the image forming apparatus can be more compact and a first print time can be reduced.

As described above, in the illustrative embodiments of the present invention, by combining together the fixing method and the transfer fixing method, durability of the image carriers, such as photoreceptors and the intermediate transfer member, can be enhanced, and a relatively high image quality can be achieved using less energy.

It is to be noted that as can be appreciated by those skilled in the art, the present invention is not limited to the embodiment described above using figures.

Numerous additional modifications and variations are possible in light of the above teachings. It is therefore to be understood that, within the scope of the appended claims, the disclosure of this patent specification may be practiced otherwise than as specifically described herein.

What is claimed is:

1. An image forming apparatus, comprising:

a plurality of first image carriers on which different color toner images C are respectively formed;

a transfer fixing member onto which a multicolor toner image A consisting of the different color toner images C is transferred;

a heater configured to fuse the toner image A on the transfer fixing member;

a pressurizer pressing against the transfer fixing member, configured to form a nip, together with the transfer fixing member, in which the fused toner image A is transferred from the transfer fixing member and fixed on a recording medium;

an image carrier located upstream of the transfer fixing member in a direction in which the recording medium is transported, on which a toner image B whose color is different from a color of the toner image A is formed; and a transferer facing the image carrier, configured to transfer the toner image B onto the recording medium before the toner image A is transferred thereonto, wherein the toner image B is fixed by the transfer fixing member and the pressurizer on the recording medium.

2. The image forming apparatus according to claim 1, wherein the toner image A comprises magenta, cyan, and yellow toners, and the toner image B comprises black toner.

3. The image forming apparatus according to claim 1, wherein the transfer fixing member contacts each of the first image carriers and the toner images C are transferred from the first image carriers and superimposed to form the toner image A on the transfer fixing member.

4. The image forming apparatus according to claim 1, wherein the plurality of first image carriers are disengageable from the transfer fixing member.

5. The image forming apparatus according to claim 4, wherein the second image carrier is disengageable from the transfer fixing member.

6. The image forming apparatus according to claim 4, wherein the plurality of first image carriers are disengageable from the second image carrier.

7. The image forming apparatus according to claim 1, further comprising a second image carrier located to contact the plurality of first image carriers, on which the toner images C are superimposed to form the toner image A, wherein the transfer fixing member contacts the second image carrier and the toner image A is transferred from the second image carrier onto the transfer fixing member.

8. An image forming apparatus, comprising:

a single first image carrier on which different color toner images C are formed and superimposed one on another to form a multicolor toner image A a transfer fixing member onto which the toner image A consisting of the toner images C is transferred;

a heater configured to fuse the toner image A on the transfer fixing member;

a pressurizer pressing against the transfer fixing member, configured to form a nip, together with the transfer fixing member, in which the fused toner image A is transferred from the transfer fixing member and fixed on a recording medium;

an image carrier located upstream of the transfer fixing member in a direction in which the recording medium is transported, on which a toner image B whose color is different from a color of the toner image A is formed; and a transferer facing the image carrier, configured to transfer the toner image B onto the recording medium before the toner image A is transferred thereonto, wherein the toner image B is fixed by the transfer fixing member and the pressurizer on the recording medium.

9. The image forming apparatus according to claim 8, wherein the transfer fixing member contacts the first image carrier, and the toner image A is transferred from the first image carrier onto the transfer fixing member.

10. The image forming apparatus according to claim 9, wherein the first image carrier is disengageable from the transfer fixing member.

11. The image forming apparatus according to claim 8, further comprising a second image carrier located to contact the first image carrier, onto which the toner image A is transferred from the first image carrier, wherein the transfer fixing member contacts the second image carrier, and the toner image A is transferred from the second image carrier onto the transfer fixing member.

12. The image forming apparatus according to claim 11, wherein the second image carrier is disengageable from the transfer fixing member.

13. The image forming apparatus according to claim 11, wherein the first image carrier is disengageable from the second image carrier.

14. A control method of an image forming apparatus, the image forming apparatus comprising:

at least one first image carrier on which a toner image C is formed;

a second image carrier;

a transfer fixing member onto which a multicolor toner image A including the toner image C is transferred from the second image carrier; and a third image carrier, the control method comprising:

forming a toner image B on the third image carrier;

transferring the toner image B onto a recording medium at a position upstream of the transfer fixing member in a direction in which the recording medium is transported;

fixing the toner image B on the recording medium in a nip formed between the transfer fixing member and a pressurizer pressing against the transfer fixing member; and disengaging the second image carrier from the transfer fixing member during single color image formation, wherein a color of the toner image B is different from a color of the multicolor toner image A.

15. The control method according to claim 14, further comprising, performing, while the second image carrier is disengaged from the transfer fixing member, at least one of cooling the second image carrier, cleaning the second image carrier, adjusting an image density of the multicolor toner image A, and adjusting color deviation of the multicolor toner image A.

16. The method of controlling the image forming apparatus according to claim 14, wherein the multicolor toner image A is formed on the first image carrier.

17. The method of controlling the image forming apparatus according to claim 14, wherein the multicolor toner image A is formed on the second image carrier.

* * * * *